US008985403B2

(12) United States Patent
Lee et al.

(10) Patent No.: US 8,985,403 B2
(45) Date of Patent: Mar. 24, 2015

(54) LIGHTWEIGHT APPLICATOR SYSTEM FOR EFFICIENT EXTRUSIVE DISPENSING OF WORK MATERIAL

(71) Applicant: Patent & Investment LLC, Jessup, MD (US)

(72) Inventors: Albert Lee, Clarksville, MD (US); Huang-Cheng Yeh, Taichung (TW)

(73) Assignee: Patent & Investment LLC, Jessup, MD (US)

( * ) Notice: Subject to any disclaimer, the term of this patent is extended or adjusted under 35 U.S.C. 154(b) by 0 days.

(21) Appl. No.: 13/836,972

(22) Filed: Mar. 15, 2013

(65) Prior Publication Data

US 2014/0263469 A1 Sep. 18, 2014

(51) Int. Cl.
*B67D 7/64* (2010.01)
*B05C 17/005* (2006.01)

(52) U.S. Cl.
CPC ..... *B05C 17/00576* (2013.01)
USPC ..... 222/391; 222/327; 222/386

(58) Field of Classification Search
CPC ..... B05C 17/01; B65D 2543/00296; B65D 43/161
USPC ..... 222/391, 325, 326–327, 386, 386.5
See application file for complete search history.

(56) References Cited

U.S. PATENT DOCUMENTS

| | | | | |
|---|---|---|---|---|
| 2,877,935 | A * | 3/1959 | Sherbondy | 222/326 |
| 4,467,942 | A * | 8/1984 | Oshikubo | 222/44 |
| 5,306,147 | A * | 4/1994 | Dragan et al. | 433/90 |
| 5,743,436 | A * | 4/1998 | Wilcox et al. | 222/137 |
| 5,762,239 | A * | 6/1998 | Cossette | 222/326 |
| 5,873,499 | A * | 2/1999 | Leschinsky et al. | 222/327 |
| 5,887,765 | A * | 3/1999 | Broesamle | 222/391 |
| 6,089,412 | A * | 7/2000 | Snell et al. | 222/309 |
| 2005/0023301 | A1 * | 2/2005 | Rumrill et al. | 222/391 |
| 2008/0179351 | A1 | 7/2008 | Beckett | |
| 2009/0218372 | A1 | 9/2009 | De Man et al. | |

(Continued)

FOREIGN PATENT DOCUMENTS

| | | |
|---|---|---|
| JP | S56-12649 U | 2/1981 |
| JP | 2001-149848 A | 6/2001 |

(Continued)

OTHER PUBLICATIONS

Communication From the Japanese Patent Office Regarding a Counterpart Foreign Application Citing the References Submitted in This Document With the Notification Date (Emperor Year—H26) Oct. 21, 2014.

*Primary Examiner* — Kevin P Shaver
*Assistant Examiner* — Robert Nichols, II
(74) *Attorney, Agent, or Firm* — Rosenberg, Klein & Lee

(57) ABSTRACT

A lightweight applicator system for efficient extrusive dispensing of work material from a cartridge is provided. The applicator system includes a body having a cartridge frame portion coupled to a base frame portion. The cartridge frame portion includes first and second elongate frame members projecting longitudinally from a bracing member extending transversely therebetween to define a cartridge loading compartment. At least a portion of the bracing member is received in conformed manner by the base frame portion. A drive portion is coupled to the body, which includes a drive member selectively displaceable responsive to user actuation for extruding work material from a cartridge retained within the cartridge frame portion.

19 Claims, 17 Drawing Sheets

(56) References Cited

U.S. PATENT DOCUMENTS

| | | | | |
|---|---|---|---|---|
| 2010/0206905 | A1* | 8/2010 | Horner et al. | 222/137 |
| 2011/0095054 | A1* | 4/2011 | Hughes | 222/137 |
| 2013/0161353 | A1* | 6/2013 | Baldelli | 222/137 |

FOREIGN PATENT DOCUMENTS

| | | | |
|---|---|---|---|
| JP | 2007-532293 | A | 11/2007 |
| JP | 2008-142712 | A | 6/2008 |

* cited by examiner

LIGHTWEIGHT APPLICATOR SYSTEM FOR EFFICIENT EXTRUSIVE DISPENSING OF WORK MATERIAL

BACKGROUND OF THE INVENTION

The present invention is directed to a system for dispensing and applying a work material to various work areas. More specifically, the present invention is directed to an applicator system that is lightweight for ease of use yet efficient in operation. The reconfigurable applicator system thus minimizes the strain and fatigue associated with its operation.

Various applicator devices for dispensing sealant, adhesive, epoxy, caulk, and other such pasty work materials are known in the art. They include handheld gun-type devices in which a cartridge containing a work material is loaded into a given applicator device and engaged by the device's drive mechanism. Actuation of the drive mechanism then causes the extrusive flow of material from the loaded cartridge for application on a particular work surface or area.

Many application tasks require use of an applicator device over extended periods, frequently with widely varied manipulations to accommodate various features and constraints of the application/work area. Overall weight and bulk, therefore, tend to be important factors in determining the actual usefulness of an applicator device in practice for such applications. Not surprisingly, applicator devices of simple, lightweight construction are highly sought after by users in all but the most specialized of applications.

Yet, such simple, lightweight construction typically comes at an undesirable cost functionally. Numerous applicator devices known in the art employ various lightweight materials to lower overall weight and bulkiness. These known devices, however, suffer from a notable compromise in efficacy. For example, where a metallic frame material is substituted with a plastic or other less weighty material (typically non-metallic), the substitute material tends to be less rigid and exhibit less stiffness when under loading pressure. Hence, the resulting frame—though lighter—is invariably more prone to flexing when subjected to load conditions during use, such as when a cartridge held in the frame is driven thereagainst by a plunger type device for extrusive dispensing of its contents.

This presents notable drawbacks. First, the energy applied to drive the dispensing is not efficiently transferred for that purpose, since more of the drive energy is absorbed by the frame itself (towards frame deflection and flexing under the applied load). Regardless of whether the dispensing is driven by power assisted or manual means, then, more work is required to dispense the same amount of work material (as compared to a more rigid frame of metallic or other comparable construction). This is especially so where higher viscosity work materials are to be dispensed.

Another drawback is the structural compromise which occurs, both in terms of an applicator device's structural integrity and its overall fit and finish. Where the device's frame entails an assembly of multiple frame components, for instance, the flexing of frame components tends to loosen joints and seams, causing premature wearing of adjoining components with repeated use. Flexing at the joints and seams would also disrupt the stability and/or consistency with which the work material may be dispensed. The undesirable creakiness of assembled components during operation would also leave the feel of an imprecise, un-tuned mechanism of inferior quality.

While advances in materials technology continue to produce advanced materials of increased strength and rigidity which exhibit greater stiffness with lesser weight, such technologies are not widely accessible for use in most caulking or other such material dispensing/applying contexts. The price points typical of applicator devices in these contexts preclude the use of the most advanced materials technologies. The devices would simply be too expensive, prohibitively so in most construction, manufacturing, and other such applications for applicator devices of the type disclosed herein.

The pool of lightweight materials realistically available for use in such applicator devices is therefore limited in practice to those which remain generally inferior in strength and rigidity to heavier materials like metals, metal alloys, and others of such higher density composition (even if not necessarily metallic). The lightweight materials typically used in the art include various plastic, fiberglass, and other non-metallic materials, which heretofore have not sufficiently rivaled heavier materials like steel in overall strength and rigidity to overcome the noted drawbacks. Simply employing lightweight materials but with added (compensatory) bulk to resist deflection is no answer, for any gains in functional efficacy would be nullified by the added weight.

Attempts have been made in the art to employ the heavier materials, just less of it. For example, frame structures have been formed in applicator devices with certain portions, like a cradle structure for receiving a material containing cartridge, reduced or largely stripped away. But such attempts have come at significant cost—for instance at the cost of stable support, leaving the cartridge vulnerable to disruptive misalignment or even unintended release when the applicator device is manipulated during use.

There is, therefore, a need for an applicator system that may be easily handled and operated with minimal physical strain. There is a need for an applicator system which may be comfortably operated by users to accurately dispense a work material. There is a need for such applicator system which is light in weight yet sufficiently strong and rigid in structure to preserve efficient energy transfer for extrusive dispensing of a work material. There is furthermore a need for such applicator system which maintains stable support of a cartridge containing the work material to be dispensed.

SUMMARY OF THE INVENTION

It is an object of the present invention to provide an applicator system which may be comfortably operated to accurately dispense a work material.

It is another object of the present invention to provide an applicator system which is lightweight yet preserves sufficient strength and rigidity for efficient energy transfer in extrudably dispensing work material from a cartridge.

It is yet another object of the present invention to provide applicator system which maintains stable support of a cartridge containing the work material to be dispensed.

These and other objects are attained by an applicator system formed in accordance with the present invention for efficient extrusive dispensing of work material from a cartridge. The system comprises a body having a cartridge frame portion coupled to a base frame portion. The cartridge frame portion includes first and second elongate frame members projecting longitudinally from a bracing member extending transversely therebetween to define a cartridge loading compartment. At least a portion of the bracing member is received in conformed manner within the base frame portion. A drive portion is coupled to the body, which includes a drive member selectively displaceable responsive to user actuation for extruding work material from a cartridge retained within the cartridge frame portion.

In certain embodiments of the present invention, a lightweight applicator system formed for extrudably dispensing work material from a cartridge comprises a hybrid body having a cartridge frame portion of a first material composition coupled to a base frame portion of a second material composition. The base frame portion defines a hub structure and a handle extending therefrom. The cartridge frame portion includes a proximal closed end and a plurality of transversely spaced frame members projecting longitudinally from the proximal closed end to a distal end to define a cartridge loading compartment therebetween. The proximal closed end is captured in conformed manner by the hub structure. A drive portion is coupled to the hybrid body. The drive portion includes a drive member selectively displaceable responsive to user actuation for extruding work material from a cartridge retained within the cartridge frame portion.

In certain other embodiments of the present invention, a lightweight applicator system for extrudably dispensing work material from a cartridge comprises a body having a cartridge frame portion coupled to a base frame portion. The cartridge frame portion includes a proximal closed end, a distal end, and a pair of transversely spaced frame members projecting longitudinally therebetween to define a skeletal cage structure looped about a cartridge loading compartment. The proximal closed end is captured in the body in at least partially embedded manner. The base frame portion defines a hub structure and a handle extending therefrom. The hub structure includes a plurality of stabilizing clip members extending into the cartridge loading compartment. A drive portion is coupled to the body, and includes a drive member selectively displaceable responsive to user actuation for engaging a cartridge retained within the cartridge frame portion to extrude work material therefrom.

DETAILED DESCRIPTION OF THE PREFERRED EMBODIMENTS

Referring now to FIGS. 1-7, there is illustratively shown a lightweight applicator system 10 formed in accordance with one exemplary embodiment of the present invention. Briefly, the applicator system 10 is configured such that it may be loaded securely with one or more cartridges 5 containing a particular work material, then actuated to cause the work material's extruded dispensing from the cartridge onto a work surface. The applicator system 10 is constructed to minimize overall weight and bulk, while preserving the structural properties required for maximum transfer of energy to drive such dispensing. The applicator system 10 is so constructed that it maintains stable support and secure retention of the cartridge loaded therein during operation.

In the embodiment shown, the applicator system 10 is configured to accommodate a cylindrical cartridge 5 of a type often employed in the art. In alternate embodiments, of course, applicator system 10 may be configured to suitably accommodate cartridges of various other type, and system 10 is not limited to any cartridge type in particular. The cylindrical cartridge type shown contains the given work material within a tubular cylinder having a circular sectional contour. The cartridge 5 is provided at its front end with a tip which is cut open to provide a dispensing nozzle. It is provided at its rear end with a displaceable plunging disk that may be axially driven forward to force the work material out through the dispensing tip.

Turning back to the applicator system 10 itself, the system is preferably constructed with a body which generally incorporates skeletal framework features in suitable degree to eliminate excess weight, and does so without incurring undue loss of strength and rigidity in the resulting structure. That is, the applicator system 10 exhibits a level of stiffness not seen in applicator devices known in the art, except those formed largely or entirely of metallic or other such hard, high density materials. The system 10 is therefore able to bear the load of a driving force applied to the cartridge held therein without undue deflection. The applied driving force is efficiently transferred to the cartridge as a result, such that virtually all its energy goes toward extrudably forcing the work material out of the cartridge (rather than deflecting the system's framework).

The applicator system 10 is preferably formed in the disclosed embodiment with a body that is of hybrid construction, wherein that portion of the framework which primarily and most directly bears the driving load is formed of a first material of greater rigidity (even if heavier in weight than a second material), while the remaining frame portion(s) is formed of a lighter, if less rigid, second material. This primary load bearing frame portion is configured structurally such that it tends to isolate and distribute the drive load within itself, thereby maintaining stiff support against the applied load.

Figure 1:
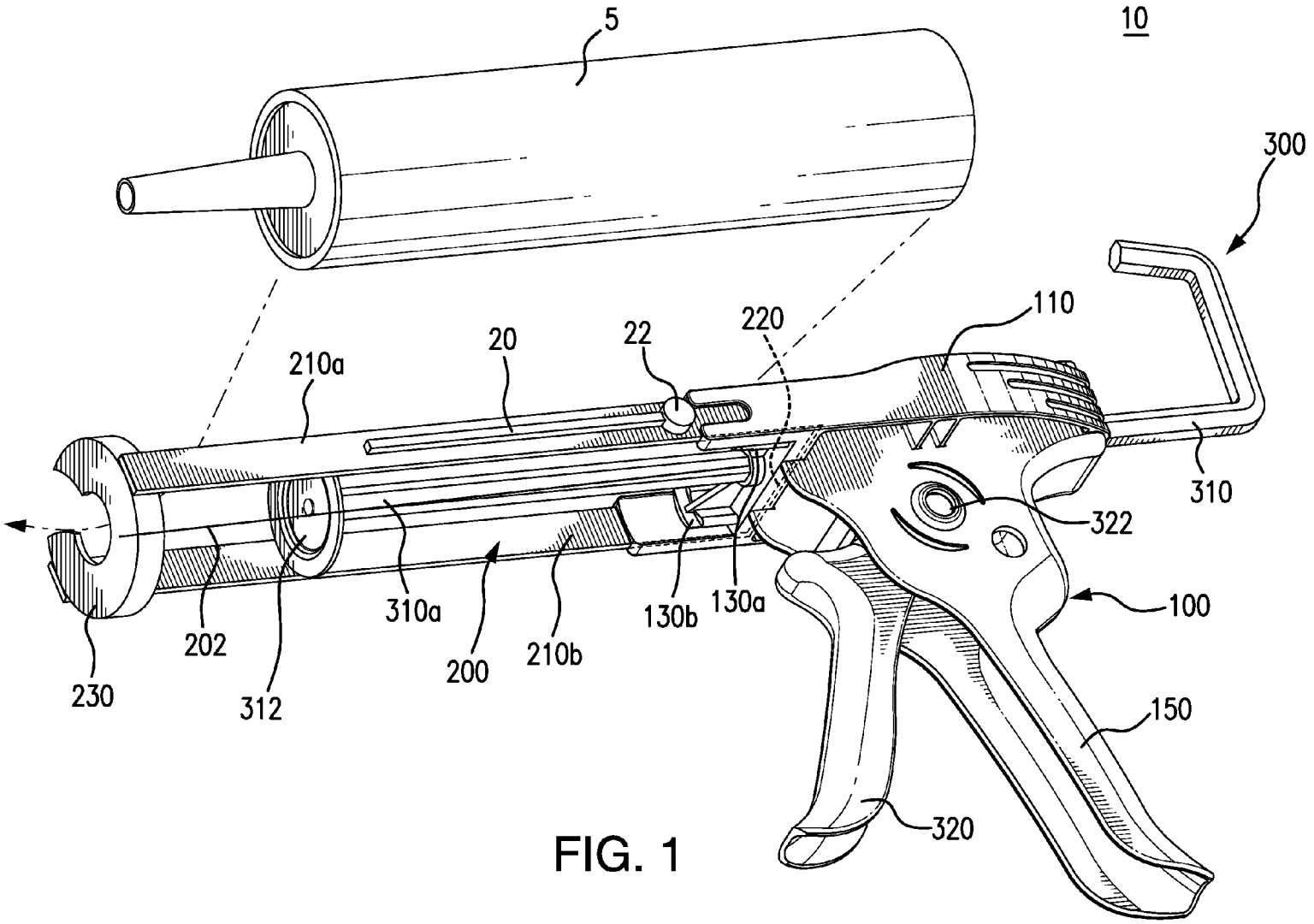
FIG. 1 is a frontal perspective view from a lower side of a system formed in accordance with one exemplary embodiment of the present invention.
Figure 1A:
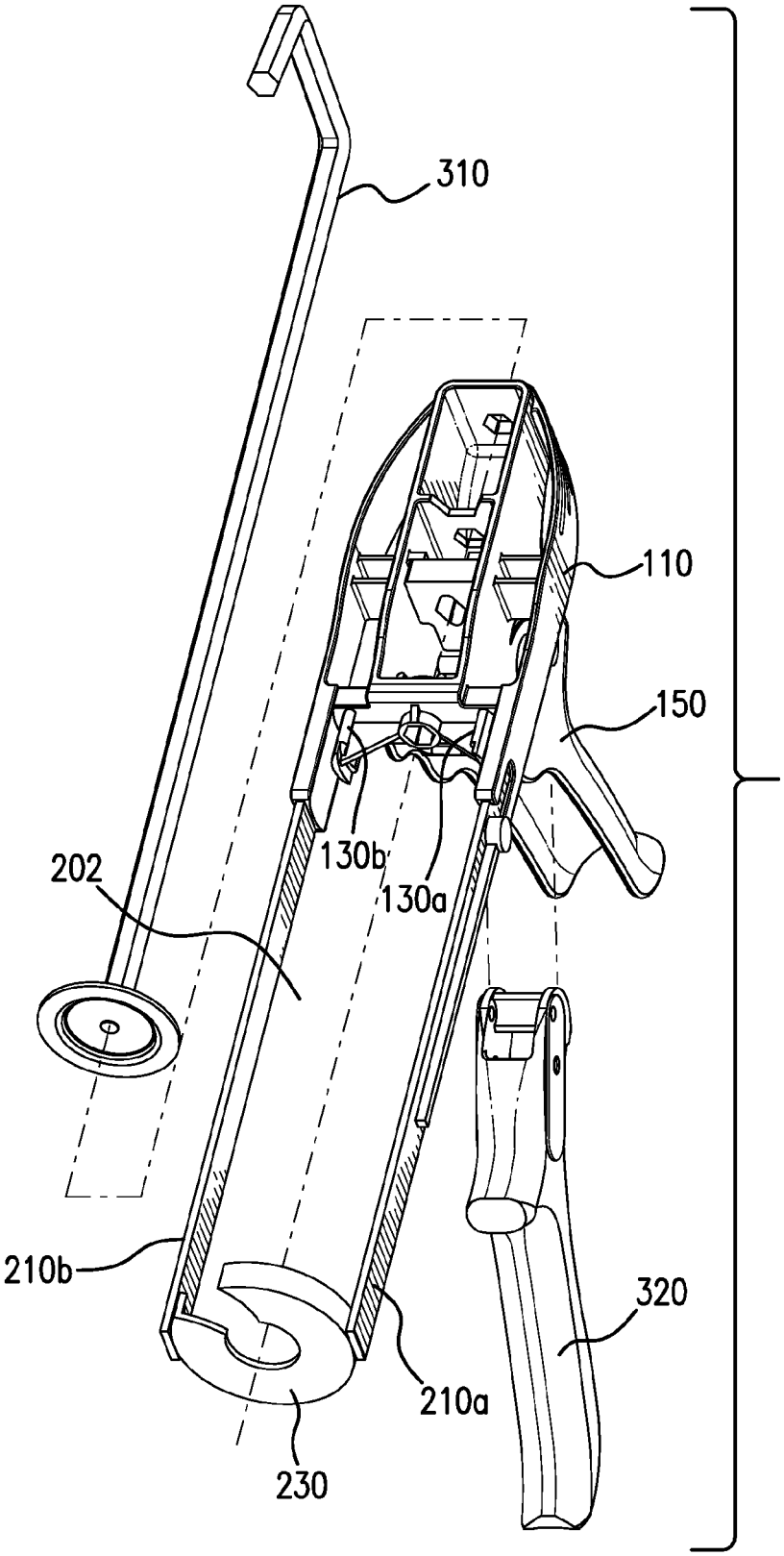
FIG. 1A is an exploded upper frontal perspective view of the system embodiment of FIG. 1, with certain components removed for clarity of illustration.

As shown in FIGS. 1-1A, the applicator system 10 comprises a body generally formed by a handle frame portion 100 and a cartridge frame portion 200. The applicator system 10 comprises as well a drive portion 300 operably coupled to the body, which includes a drive member 310 displaceable relative to the body. The drive member 310 when driven applies a drive force on the cartridge 5 held by the cartridge frame portion 200 to force work material therefrom.

As described in preceding paragraphs, the body is preferably formed in the exemplary embodiment shown with a hybrid structure, where the cartridge frame portion 200 is formed of a first material such as steel or other suitable metallic material, and the handle frame portion 100 is formed of a second material such as a hard plastic, rubber, or other suitable material of less weight. Other combinations of materials may be employed for the hybrid structure, so long as the resultant cartridge frame portion 200 exhibits strength and stiffness comparable to or exceeding those of metallic materials. Additional structural measures are preferably taken to minimize the weight of each frame portion 100, 200, as evinced by the skeletal configurations preferably employed in both.

The cartridge frame portion 200 is preferably formed with a plurality of elongate frame members 210*a*, 210*b* which project longitudinally from a bracing member 220 extending transversely therebetween. The bracing member 220 is integrally formed with the frame members 210*a*, 210*b* to establish a cross member contiguously extending from and between bends made at the proximate extents of those frame members 210*a*, 210*b* (relative to the handle frame portion 100). That is, the frame members 210*a*, 210*b*, and bracing member 220 together define a contiguous one-piece proximate closed end frame structure for the cartridge frame portion 200. At least a part of this proximate closed end is then received in conformed manner by the handle frame portion 100 to be tightly and securely held thereby.

The bracing member 220 may be integrally formed in other ways with frame members 210*a*, 210*b*. In certain alternate embodiments, for example, the bracing member 220 may be integrally formed via welding or other suitable measures known in the art to be fused rigidly with the frame members 210*a*, 210*b* at/near their proximate ends. Regardless of the actual means of implementation, the integral formation of the resulting closed end yields a joint-less, uni-frame, or one-piece structure that optimizes stiffness and overall structural integrity of the cartridge frame portion 200.

A front cap 230 is coupled between the distal ends terminating the frame members 210*a*, 210*b* for supporting engagement of the front of the cartridge 5. This front cap 230 completes a looped open cage structure for the cartridge frame portion 200 in the disclosed embodiment. Such open cage structure exhibits great stiffness, as it is formed of a rigid, metallic bar-shaped material (in this example), with minimal weight, as its skeletal configuration is devoid of extraneous components that might contribute excess weight. As described in following paragraphs, other measures (such as stabilizing clip members) are provided in accordance with certain aspects of the present invention that enable the use of such simple cage structure. Those other measures obviate the need for such things as extraneous cradle or other cartridge support/retention components intermediately between the longitudinally opposed proximate and distal ends of the cartridge frame portion 200.

The open cage structure of frame portion 200 encircles a cartridge loading compartment 202 that is fully open between the longitudinally opposed ends except at the frame members 210*a*, 210*b* which peripherally bound the compartment. Such open cage structure advantageously provides a measure of modularity for the cartridge frame portion 200. Once separately constructed, the cartridge frame portion 200 may be suitably coupled to the handle frame portion 100 by inserting and capturing the proximate closed end within an embedding groove formed in the handle frame portion. Where appropriate for the intended application, the proximate closed end may be releasably captured in the embedding groove. The cartridge frame portion 200 may alternatively be coupled by molding some or all of the handle frame portion about the proximate closed end using a suitable technique known in the art, such as die injection. In any event, the combined structure may then be assembled with the drive portion 300.

The system 10 is preferably though not necessarily equipped in the illustrated embodiment with a cleanout/poker tool 20, which may be extended and used for axially penetrating the dispensing tip of the cartridge 5 to remove residual material therefrom and perforating a membrane seal for initial access to the work material. The cleanout tool 20 is shown coupled to the cartridge frame portion via an angularly displaceable pivot member 22 to swing between active and stowed angular positions thereabout.

In the illustrated embodiment, the frame and bracing members 210*a*, 210*b*, 220 are formed as sections bent along one contiguous band-like metallic bar. The sectional contour and overall dimensional configuration of these members are suitably determined according to the particular requirements of the intended application. In certain alternate embodiments, the frame and bracing members 210*a*, 210*b*, 220 may be formed as metallic sections having various other sectional contours and various other dimensional configurations, or various combinations of such other sectional contours and dimensional configurations. One or more of the members 210*a*, 210*b*, 220, for example, may be formed using more of a rod-like bar having an oblong, rounded, or any other sectional contour suitable for the particularly intended application.

Furthermore, each of the frame members 210*a*, 210*b* may be formed with something other than the solid bar structure shown. For example, where the requirements of a particular application dictate, one or more of the frame members may be integrally formed yet with an open truss structure in which a cross-oriented network of bracing members provides strength and rigidity while further reducing weight, much as seen in bridge construction. The added cost and complexity of such embodiments, however, may outweigh their benefits in many applications, limiting applicability to certain select contexts.

Also in the illustrated embodiment, the frame members 210*a*, 210*b* extend substantially in parallel and are mutually disposed on a lateral plane relative to the handle frame portion 100. This is but one of numerous configurations and relative positions and orientations in which the frame members 210*a*, 210*b* may be implemented. In certain alternate embodiments, for instance, the frame members may be bowed, bent, or of certain irregular contour to accommodate the needs of the intended application. Moreover, one frame member may be directed in a different angular orientation in at least one plane relative to the other frame member(s) (such as frame members that may be substantially parallel in a lateral plane being mutually crossed in a vertical plane). In certain other alternate embodiments, the frame members may be transversely offset from one another but mutually disposed on an inclined or vertical plane relative to the handle frame portion 100. In still other alternate embodiments, the frame members may be unevenly, asymmetrically spaced about the drive member section 310*a* extending through the cartridge loading compartment 202. These and other configurational variations may be implemented as needed for the particular requirements of the intended application.

Unlike the cartridge frame portion 200 which primarily bears the driving load when the drive member 310 is driven to advance into the cartridge loading compartment against the cartridge held there, the handle frame portion 100 may be formed of a lesser weight material that may not be as strong or rigid. The handle frame portion 100 in the illustrated embodiment is preferably formed of a hard plastic or other suitable material known in the art. It includes a hub structure 110 from which a handle 150 extends as shown. The handle frame portion 100 is also preferably implemented with a skeletal configuration, having both the hub structure 110 and handle 150 molded or otherwise shaped and contoured to describe generally shell-like structural components.

The hub structure 110 serves as the main housing for the assembly of drive mechanism hardware implementing the drive portion 300. The hub structure 110 is formed with an internal honeycomb type network of bracing partitions 113, 114, 115 (see FIGS. 4-5) defined within an outer wall 112. An internal housing region bounded by the internal partitions/walls 114 houses a ratcheting or any other suitable mechanism known in the art for retractably advancing the drive member 310 into the cartridge loading compartment. This internal housing region is reinforced against the outer wall 112 by the bracing partitions 113.

Figure 4:
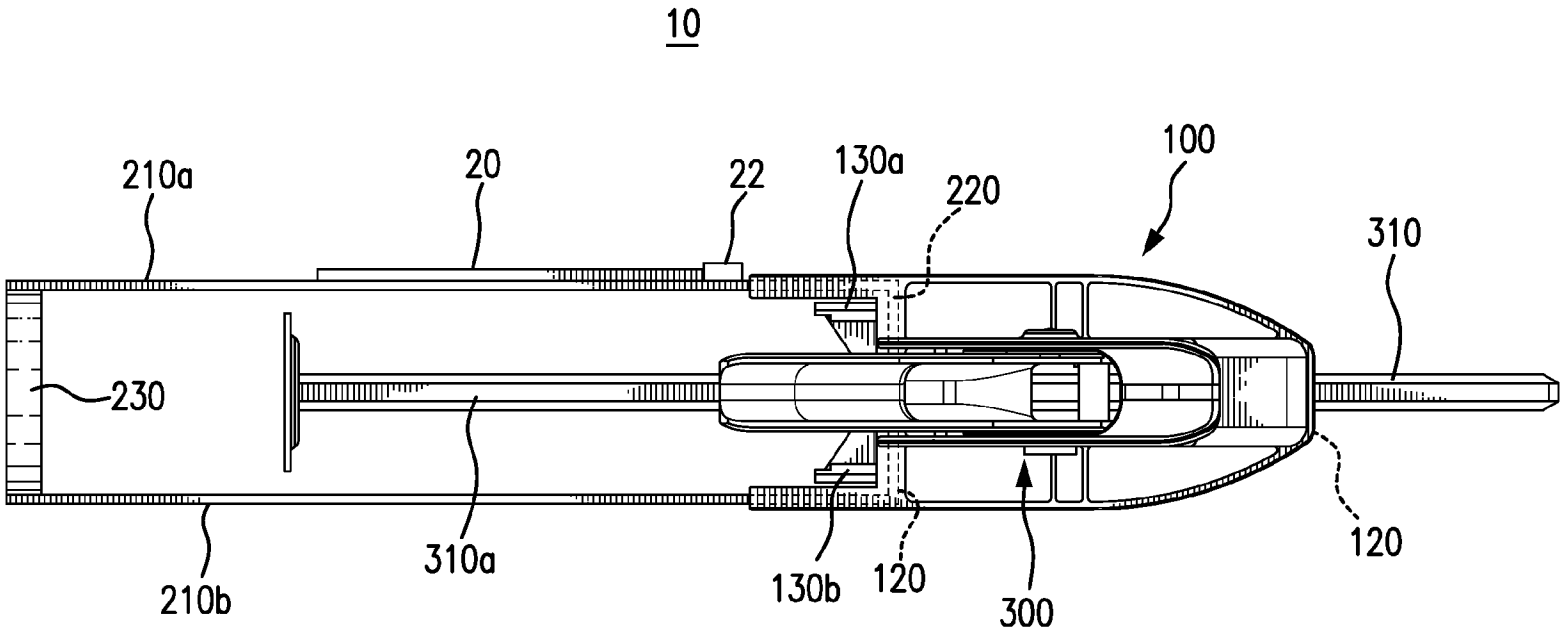
FIG. 4 is a bottom plan view of the system embodiment of FIG. 1.
Figure 5:
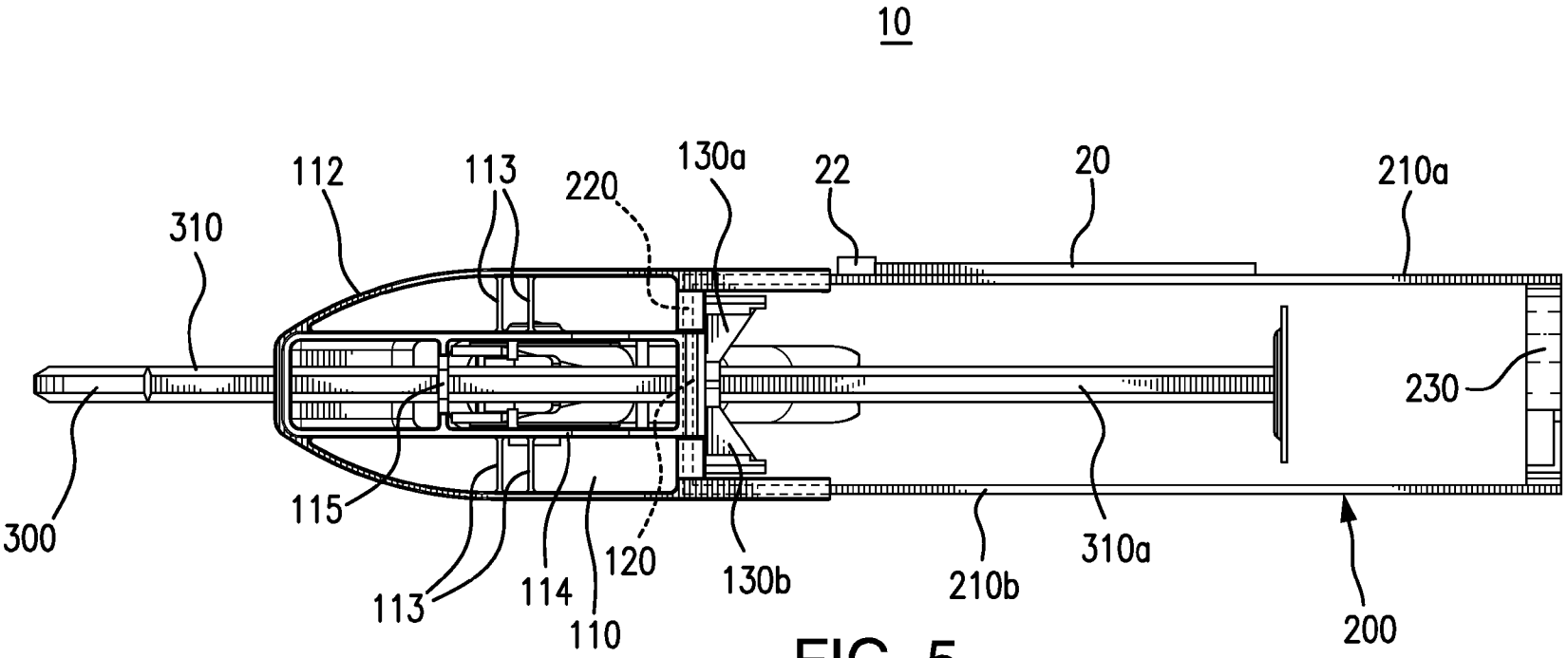
FIG. 5 is a top plan view of the system embodiment of FIG. 1.
Figure 6:
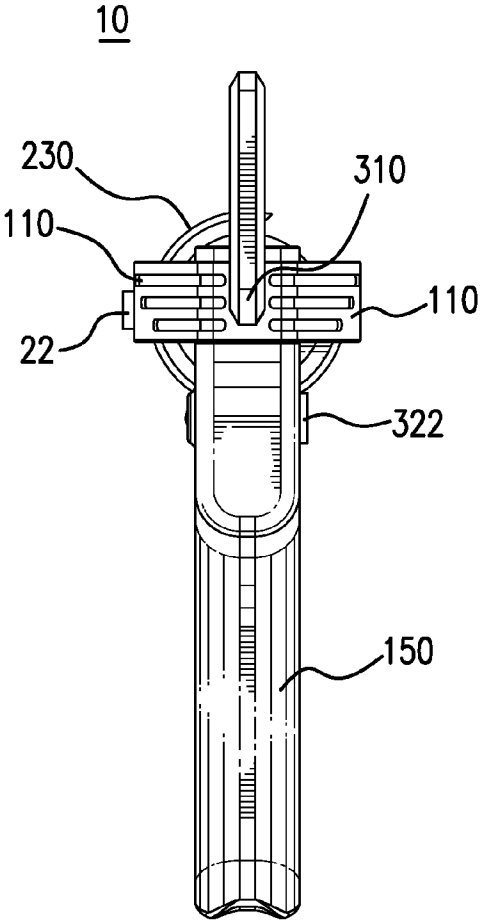
FIG. 6 is a rear elevational view of the system embodiment of FIG. 1.
Figure 7:
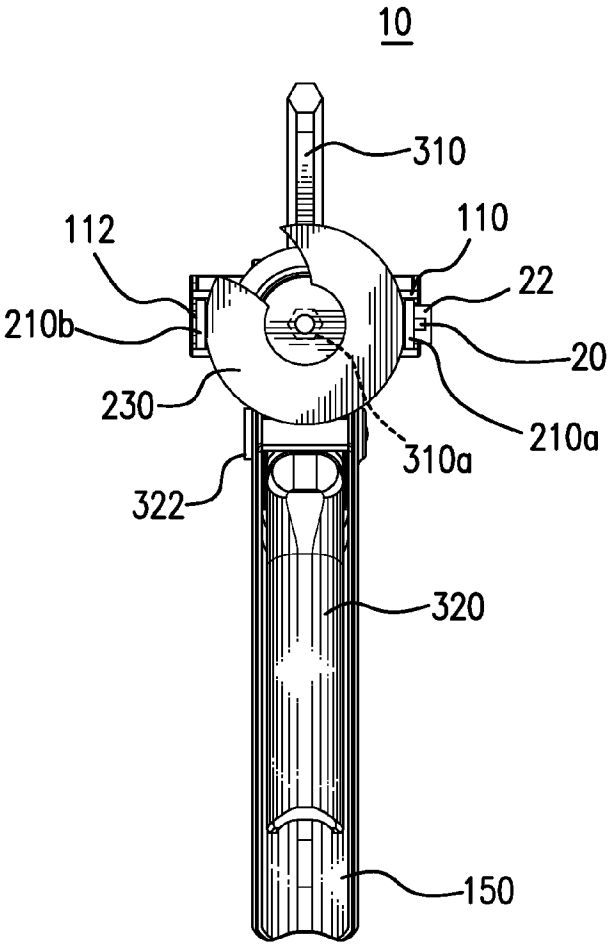
FIG. 7 is a front elevational view of the system embodiment of FIG. 1.

As shown most clearly in FIGS. 4-5, the hub structure 110 of the handle frame portion 100 is preferably configured to receive at least the bracing member 220 (or certain portions thereof) in intimately conformed manner. An embedding groove 120 is preferably formed in the hub structure 110 toward that end, configured to firmly support the entire cartridge frame portion 200 by the intimate engagement. During assembly of the handle frame portion 100, the bracing member 220 and preferably the proximate parts of the frame members 210*a*, 210*b* (which collectively define the substantially u-shaped proximate closed end) of the cartridge frame portion's open cage structure may then be force fit into the engagement with the embedding groove 120, and captured there upon full assembly of the handle frame portion 100 thereafter. Alternatively, at least the hub structure 110 of the handle frame portion 100 may be molded about the bracing member 220 and/or the proximate closed end that the bracing member 220 forms with the proximate parts of the frame members 210*a*, 210*b*. In certain other alternate embodiments, the proximate closed end may be received in conformed manner by the hub structure 100, but by securement against an outer surface thereof. The proximate closed end would then be accommodated within suitable recesses or supported by suitable clips or similar formations, for instance, rather than being inserted within an embedding groove.

Regardless of how the cartridge frame portion 200 is coupled to the handle frame portion 100, the bracing member 220 provides cross-bracing reinforcement and rear support during system operation. Thus, when the drive member 310 is driven longitudinally forward, so as to force the cartridge forward against the front cap 230 of the cartridge frame portion 200, the open cage structure does not give way to flexing under the resulting load force. The open cage structure is stiff enough to substantially maintain its undeflected shape. Virtually all of the driving force is then imparted to the proper target, namely the rear plunging end of the cartridge.

The drive portion 300 employs in the illustrated embodiment a drive mechanism manually powered by user actuation to extrusively dispense the work material onto the given work area. Depending on the intended application, the system 10 may alternatively employ a drive mechanism of power assist type (either partially or fully), where user activation of a trigger or button control actuates a power-assisted, automatic drive of the dispensing process. But the various power assist mechanisms known in the art—such as pneumatic, hydraulic, electro-mechanical, electro-magnetic, or the like—are likely to add too much weight and complexity to be a viable option in many (though not necessarily all) applications.

Referring back to the drive portion 300 as shown in the illustrated embodiment, the drive portion 300 may be of any suitable type known in the art. As such, the drive portion 300 may employ any suitable type of drive mechanism. The example shown in the illustrated embodiment is of the ratcheting type operating on the drive member 310 that passes displaceably through the hub structure 110 and proximate closed end of the cradle frame portion 200 held therein. The drive portion 300 in this example includes a trigger 320 coupled by a pivot member 322 to an upper part of the handle 150 for pivotal displacement thereabout. The trigger 320 is preferably biased by a spring or other resilient member (not shown) to be displaced outward from the handle 150. Once it is squeezed toward the handle 150 for one pull stroke, the trigger 320 is automatically returned for squeezing in a further pull stroke. With each pull stroke, the ratcheting drive mechanism incrementally advances then holds the drive member 310 further into the cartridge loading compartment 202, against the cartridge 5 loaded there.

While the given drive mechanism is suitably housed within the hub structure 110 as described herein, the present invention is not limited to any particular choice of type, nor to any particular choice of structure and configuration for the drive mechanism. Hence, the drive portion 300 is not described in further detail.

It is not enough for efficient operation of the applicator system 10 that the drive energy be efficiently delivered to the cartridge 5 loaded therein. If the cartridge 5 is not held in proper longitudinal alignment within the cartridge loading compartment 202, or if it is not securely enough retained there, the efficiently transferred energy will have been largely wasted. For proper operation of system 10, the cartridge must remain sufficiently supported to avoid misalignment with the drive member section 310*a*. Only then will the plunging disk portion of the cartridge 5 be pushed straight in for proper extrusion of the work material therefrom. Otherwise, the operational seal between the disk and surrounding portions at the rear end of the cartridge 5 could be disrupted, and a messy leak of the work material could occur. Yet, the weight minimizing open cage structure of the cartridge frame portion 200 does away with trough like cradle structures normally employed in applicator devices known in the art for stabilizing a cartridge.

Supplemental measures may be employed on the longitudinal section 310*a* of the drive member 310 to help remedy the situation. For example, a push disk 312 diametrically sized to transaxially span an inner cavity of the cartridge cylinder 5 (as it pushes the plunging disk of the cartridge forward) may be attached at the tip of the drive member section 310*a*. While this may help to provide ample stabilizing support when the cartridge 5 is full (and only a short span of the drive member section 310*a* is freely suspended from the hub structure 110), the support diminishes as the cartridge empties (and an increasingly longer span of the drive member 310*a* becomes freely suspended from the hub structure 110). Indeed, as the cartridge 5 empties and lightens, and the drive force longer sustained, the tendency for cartridge misalignment increases.

Figure 1B:
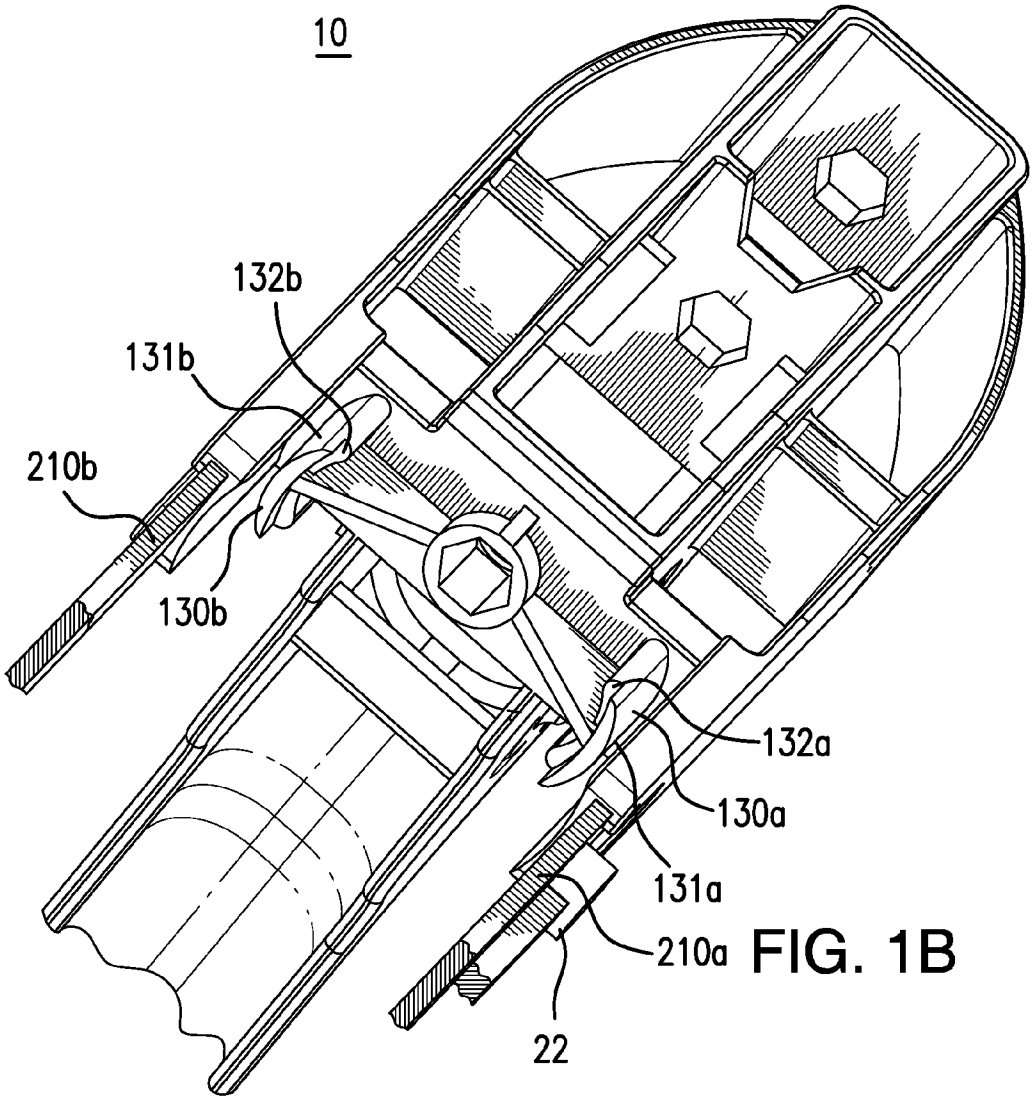
FIG. 1B is an enlarged perspective view of a portion of the system embodiment of FIG. 1.
Figure 2:
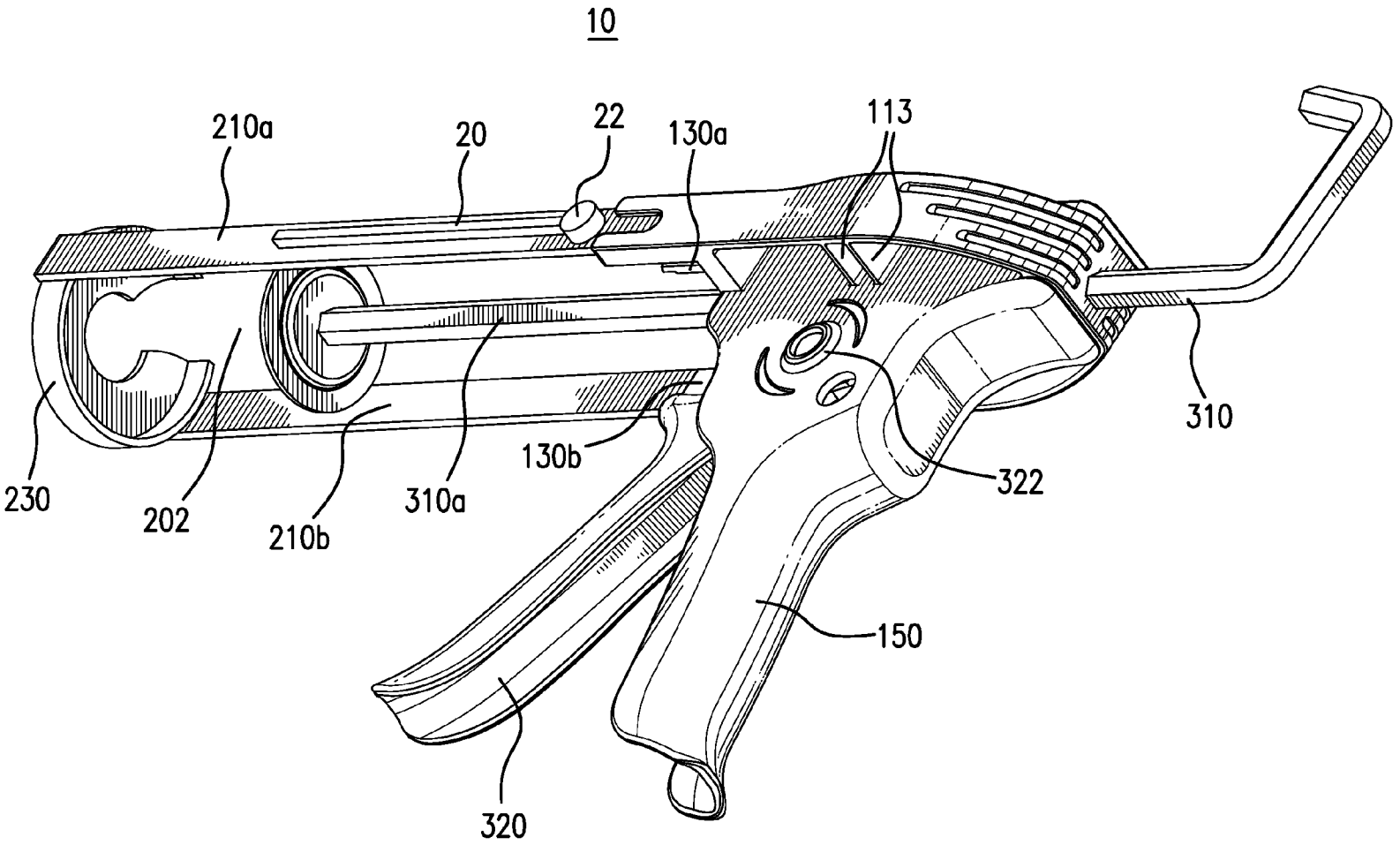
FIG. 2 is a rear perspective view from a lower side of the system embodiment of FIG. 1.
Figure 2A:
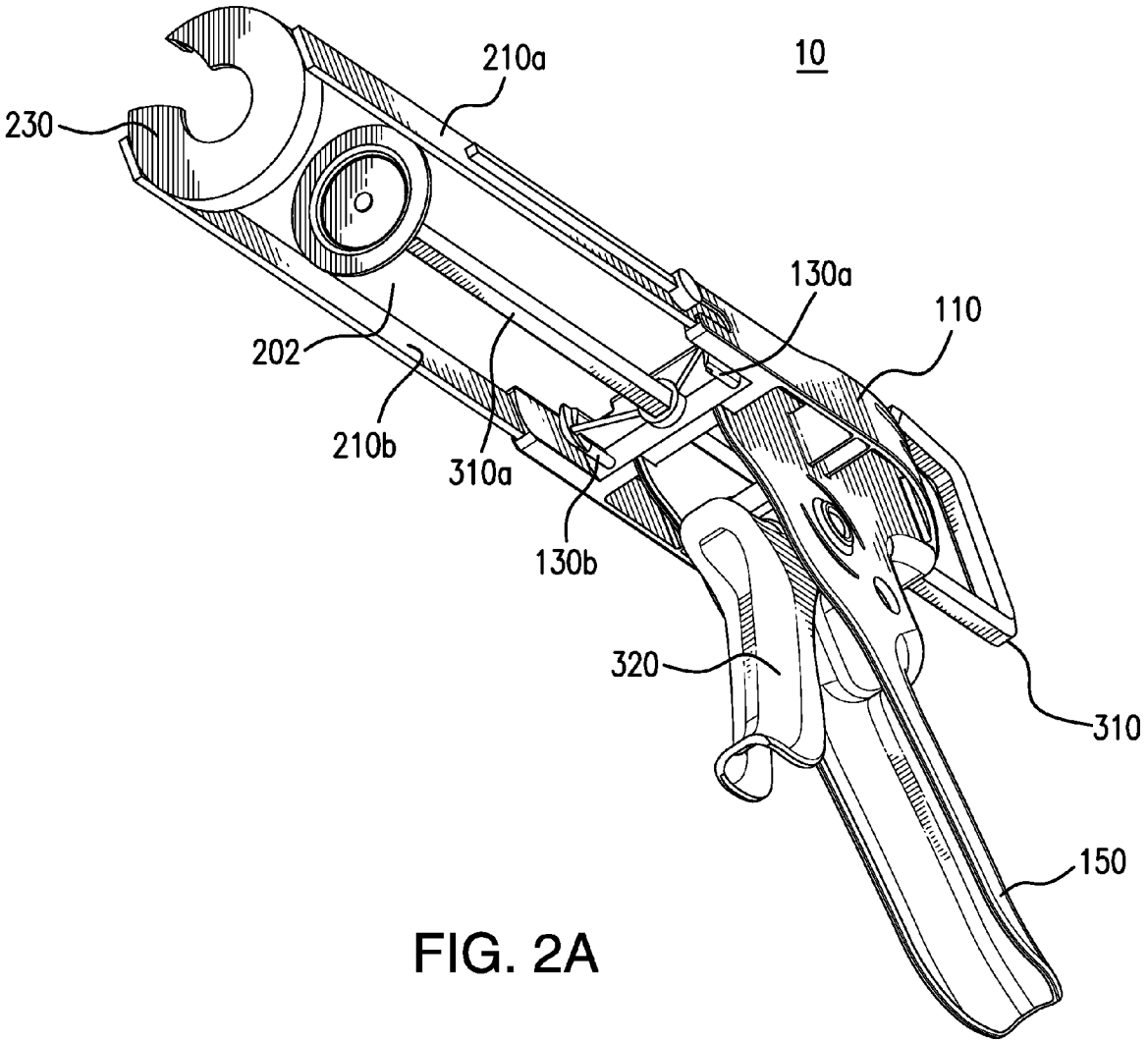
FIG. 2A is a bottom perspective view of the system embodiment of FIG. 1.
Figure 2B:
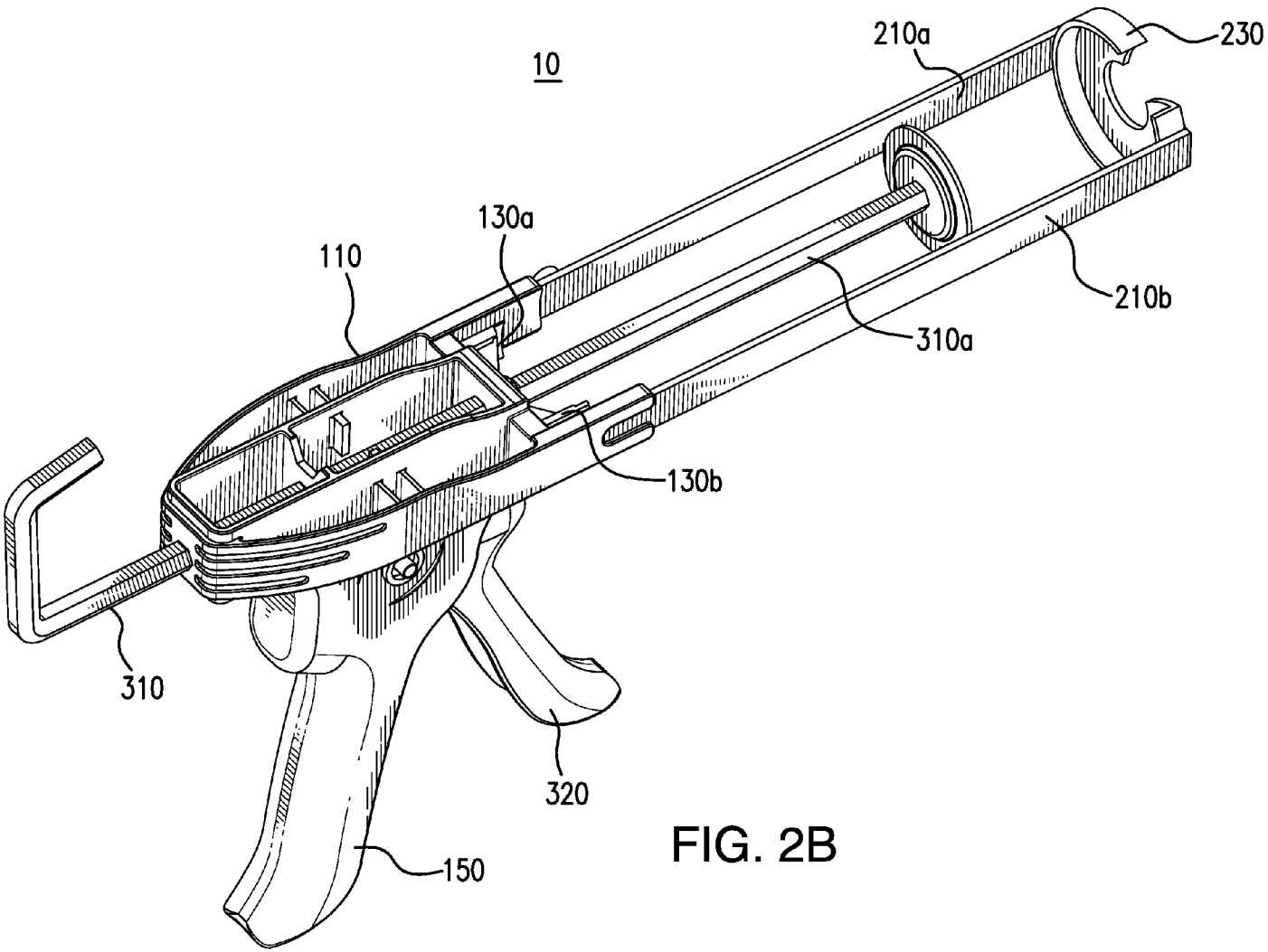
FIG. 2B is a rear perspective view from an upper side of the system embodiment of FIG. 1.
Figure 3A:
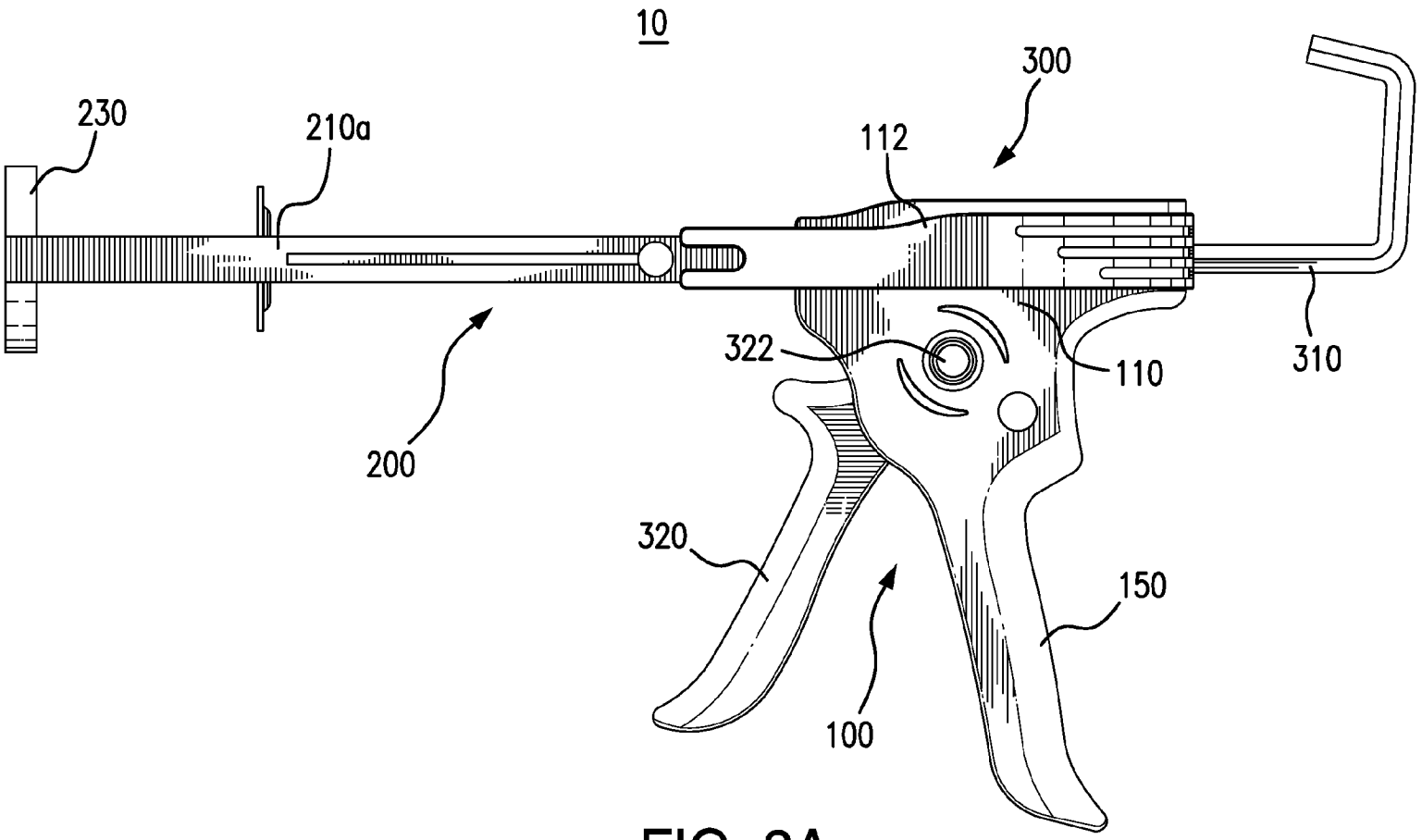
FIG. 3A is a left side elevational view of the system embodiment of FIG. 1.
Figure 3B:
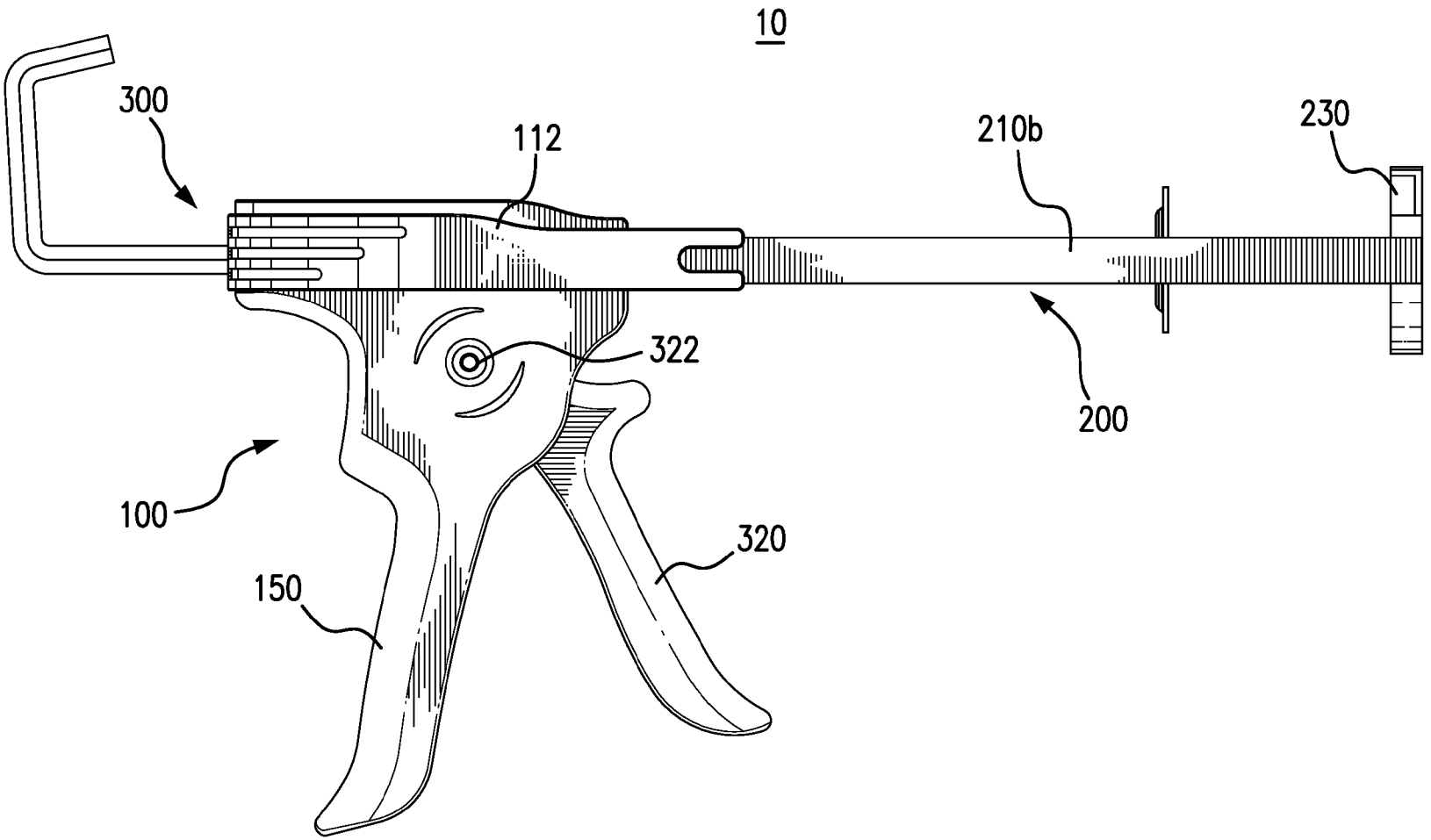
FIG. 3B is a right side elevational view of the system embodiment of FIG. 1.

In accordance with certain aspects of the present invention, therefore, the applicator system 10 is equipped with a plurality of stabilizing clip members 130*a*, 130*b* formed on the handle frame portion's hub structure 110 to protrude longitudinally into the cartridge loading compartment 202. These stabilizing clip members 130*a*, 130*b*, shown most clearly in FIGS. 1 and 1B, engage and retain the rear/proximate end of the cartridge's outer cylinder against transverse (transaxial) displacement. Since the front/distal end of the cartridge 5 is firmly retained by the front cap 230, this rear retention secures the cartridge 5 both to hold against its release from the cartridge loading compartment 202 and fix its longitudinally aligned orientation therein.

Each of the stabilizing clip members 130*a*, 130*b* is suitably configured according to the shape and size of the given cartridge 5. The clip members 130*a*, 130*b* are accordingly positioned in relation to one another, and to the drive member section 310*a*, to cooperatively engage the cartridge 5 at multiple points. In the exemplary embodiment illustrated, the cartridge 5 is of a cylindrical tube. Each of the two transversely opposed stabilizing clip members employed is thus preferably formed with an arcuate outer wall 131*a*, 131*b* generally corresponding in curvature to that of the cartridge's cylindrical tube. Normally, the cartridge 5 terminates at its rear/proximate end with a tubular tail extension beyond the plunger disk which caps the work material contained within the cartridge 5. The tubular tail extension (cylindrical in this exemplary case) is then fitted over and about the arcuate outer walls 131*a*, 131*b* of the clip members 130*a*, 130*b*. The fit is preferably snug enough to restrict transverse movement of the tubular tail extension but loose enough that the tubular tail extension may be easily fitted over and removed from the clip members 130*a*, 130*b*.

Preferably, each of the stabilizing clip members 130*a*, 130*b* is formed with an inner rim or shoulder 132*a*, 132*b* defining a notch at its outermost tip. The notches provide clearance to receive the rear plunging disk disposed inside the cartridge's cylinder. The shoulders 132*a*, 132*b* provide longitudinal support for such plunging disk (at least when the cartridge 5 is full).

The stabilizing clip members 130*a*, 130*b* in the illustrated embodiment are shown to be integrally formed with the hub structure 110. Where necessary, however, such stabilizing clip members 130*a*, 130*b* may be detachably coupled to the hub structure 110 in alternate embodiments, such that one or more may be replaced to accommodate differently sized or differently shape cartridges 5. Any suitable means known in the art may be employed to provide a detachable yet sufficiently secure coupling of the stabilizing clip members 130*a*, 130*b* in this regard. One or more of the clip members 130*a*, 130*b* may then simply be snapped on and off by the user to replace one for another as needed.

The stabilizing clip members 130*a*, 130*b* may be formed in alternate embodiments with various other structural configurations to suit cartridges 5 of other type. Where the cartridge 5 is of something other than cylindrical in shape, for instance, each of the stabilizing clip members 130*a*, 130*b*, may be formed with outer walls of planar or other contour to suit the cartridge shape. What is more, the cartridge's tail extension need not necessarily fit over the stabilizing clip members 130*a*, 130*b*. In certain alternate embodiments, the cartridge tail extension may be captured internally between the stabilizing clip members 130*a*, 130*b*. In that case, each of the stabilizing clip members 130*a*, 130*b* would preferably define inner side engaging surfaces accordingly contoured to suit the outer surface of the captured cartridge tail extension.

Figure 8:
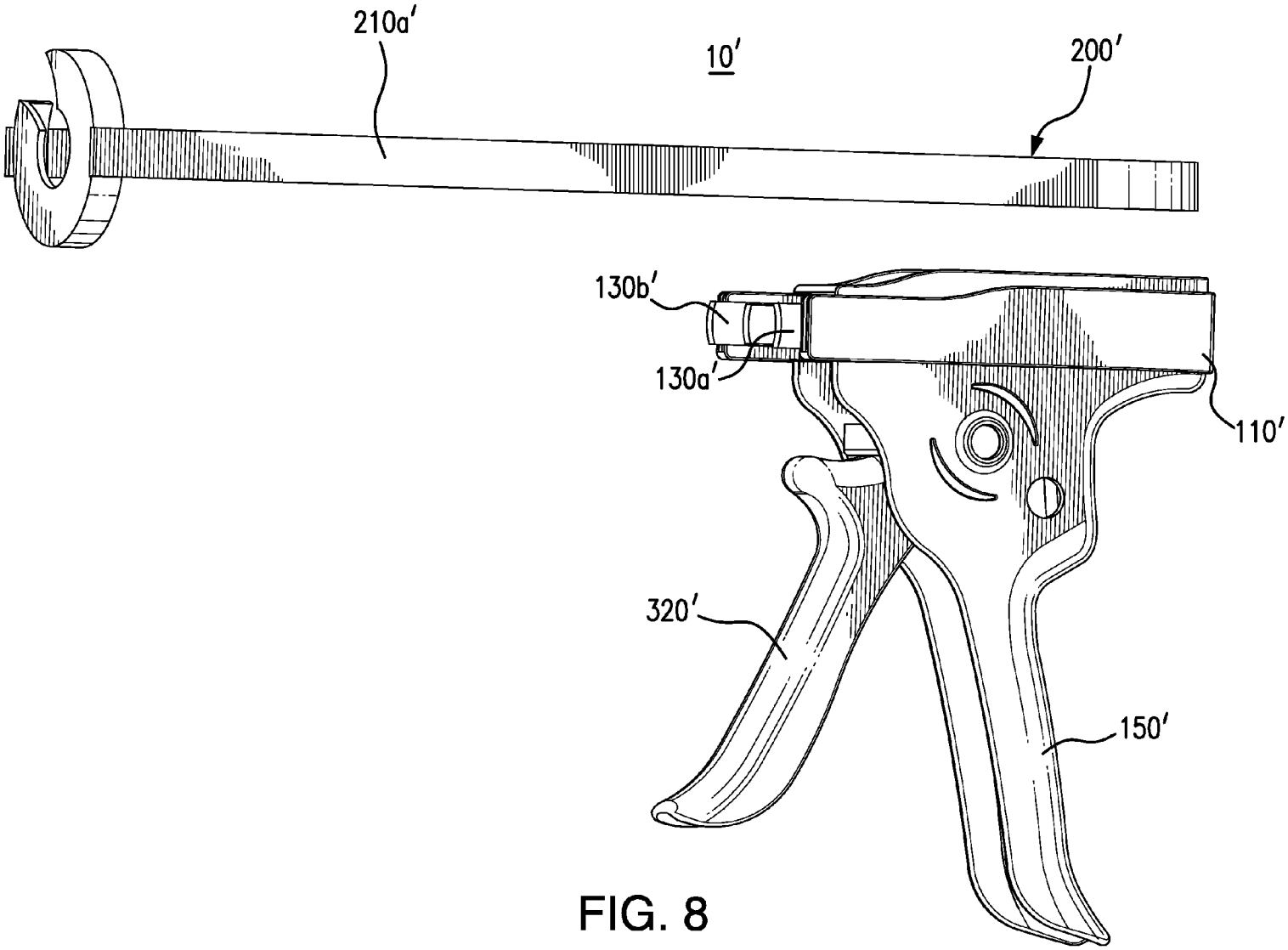
FIG. 8 is an exploded side perspective view of a portion of a system formed in accordance with an alternate embodiment of the present invention.
Figure 9:
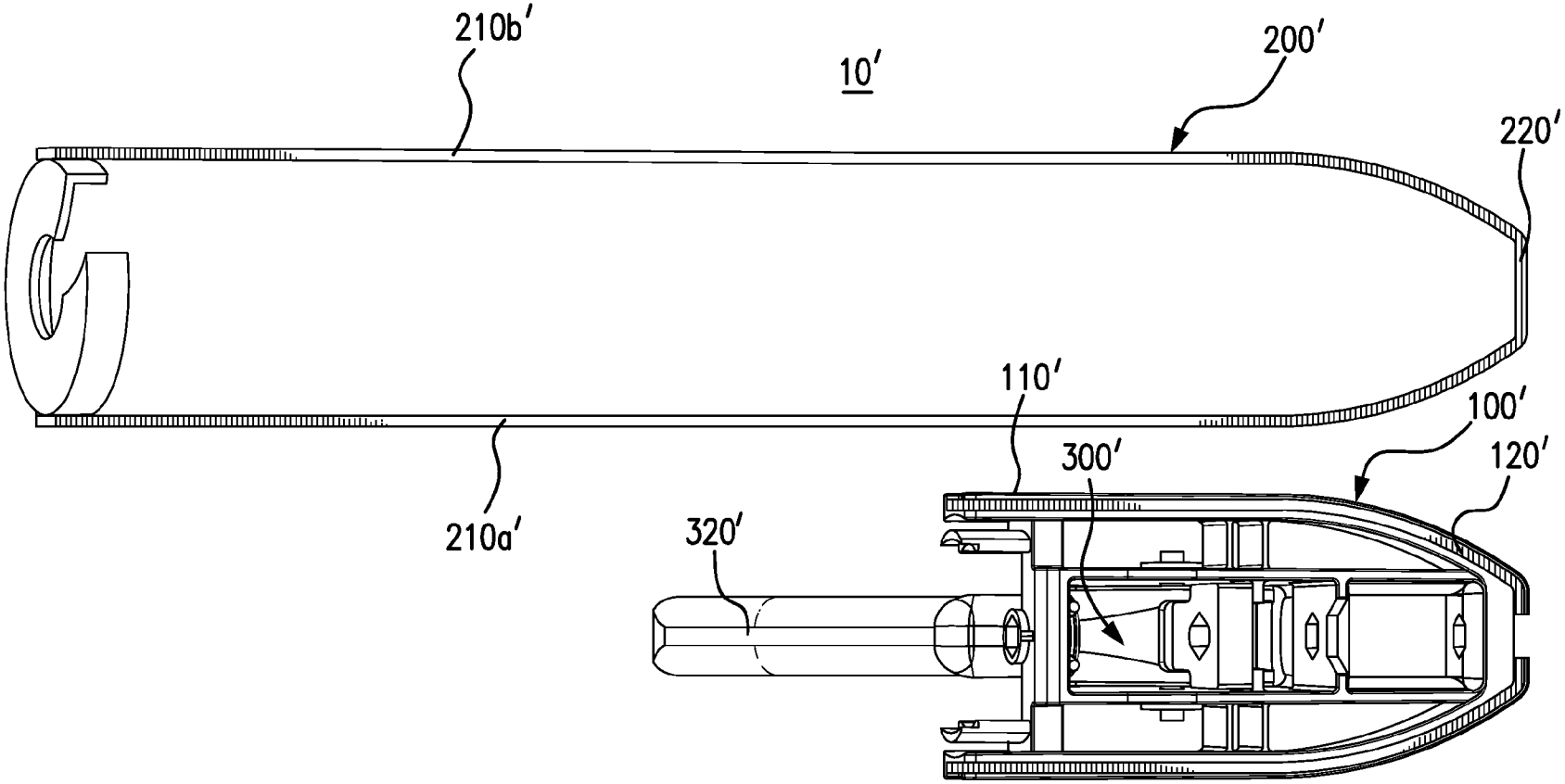
FIG. 9 is an exploded top perspective view of the portion of the alternate system embodiment of FIG. 8.
Figure 10:
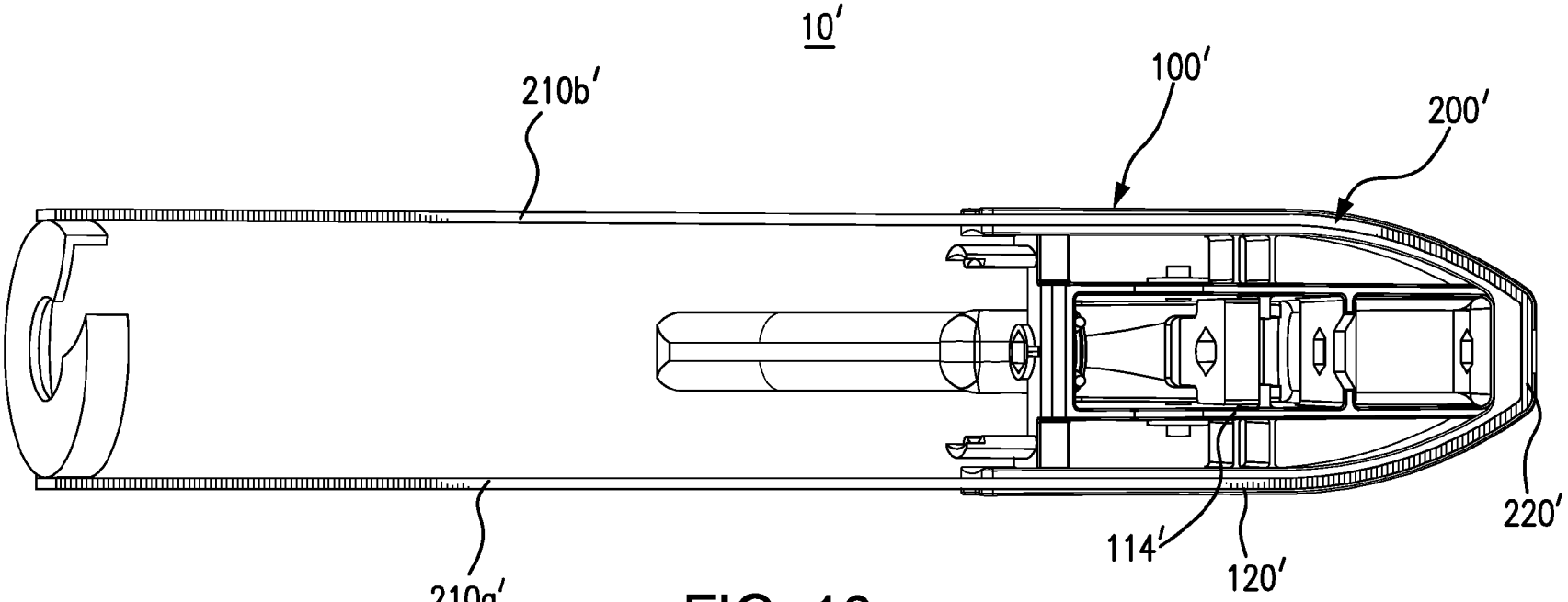
FIG. 10 is a top perspective view of the portion of the alternate system embodiment of FIG. 8.

Turning now to FIGS. 8-10, there is illustratively shown a lightweight applicator system 10' formed in accordance with another exemplary embodiment of the present invention. The applicator system 10' is generally similar in structure and function to the system 10 of the preceding embodiment, except in the configuration of its cartridge frame portion 200' and in the corresponding receiving structure of the handle frame portion 100'. Applicator system 10' in this embodiment includes a cartridge frame portion 200' having elongate side frame members 210*a*', 210*b*' that reach farther back to make conformed coupling with the handle frame portion 100'. The bracing member 220' which extends between the proximate ends of these frame members 210*a*', 210*b*' is received behind the internal frame region bounded by internal partition/walls 114' housing the drive mechanism of the drive portion 300'.

Among other things, this essentially extends the overlap between the cradle frame and handle frame portions 200', 100', and thereby expands the area of conformed coupling therebetween. As shown, the substantially u-shaped proximate closed end defined by the frame members 210*a*', 210' and bracing member 220' is received in an embedding groove 120' formed in the handle frame portion's hub structure 110' to loop substantially around the entirety of that hub structure 110'. As mentioned in preceding paragraphs, such proximate closed end may be so inserted in the embedding groove 120' then captured therein by suitable means, or the hub structure 110' may be suitably molded about that proximate closed end. Regardless, the proximate closed end is effectively embedded in the hub structure 110' for firm support of the entire cartridge frame portion 200'.

Unlike the cartridge frame portion 200 in the preceding embodiment, the portion 200' in this embodiment is inserted from the top into upwardly open embedding groove 120'. This may offer manufacturing and assembly advantages in certain applications; it may not in others. Hence, the cartridge frame portion 200' may in certain alternate embodiments be received from below in a bottom accessible embedding groove 120' (or the hub structure 110' molded about the proximate closed end to yield such bottom accessible structure).

The handle frame portion 100' is otherwise formed in this embodiment in much the same manner as the frame portion 100 of the preceding embodiment. As in that embodiment, the handle frame portion 100' includes a handle 150' extending from the hub structure 110'. A manually actuated pull trigger 320' is pivotally coupled to the handle frame portion 100' and resiliently biased for squeezed actuation displacement relative to the handle 150'. Additionally, the handle frame portion 100' includes a pair of stabilizing clip members 130*a*', 130*b*' protruding longitudinally into the cartridge loading compartment from the hub structure 110' to help maintain stable support and secure retention of a cartridge loaded therein during operation.

Figure 11:
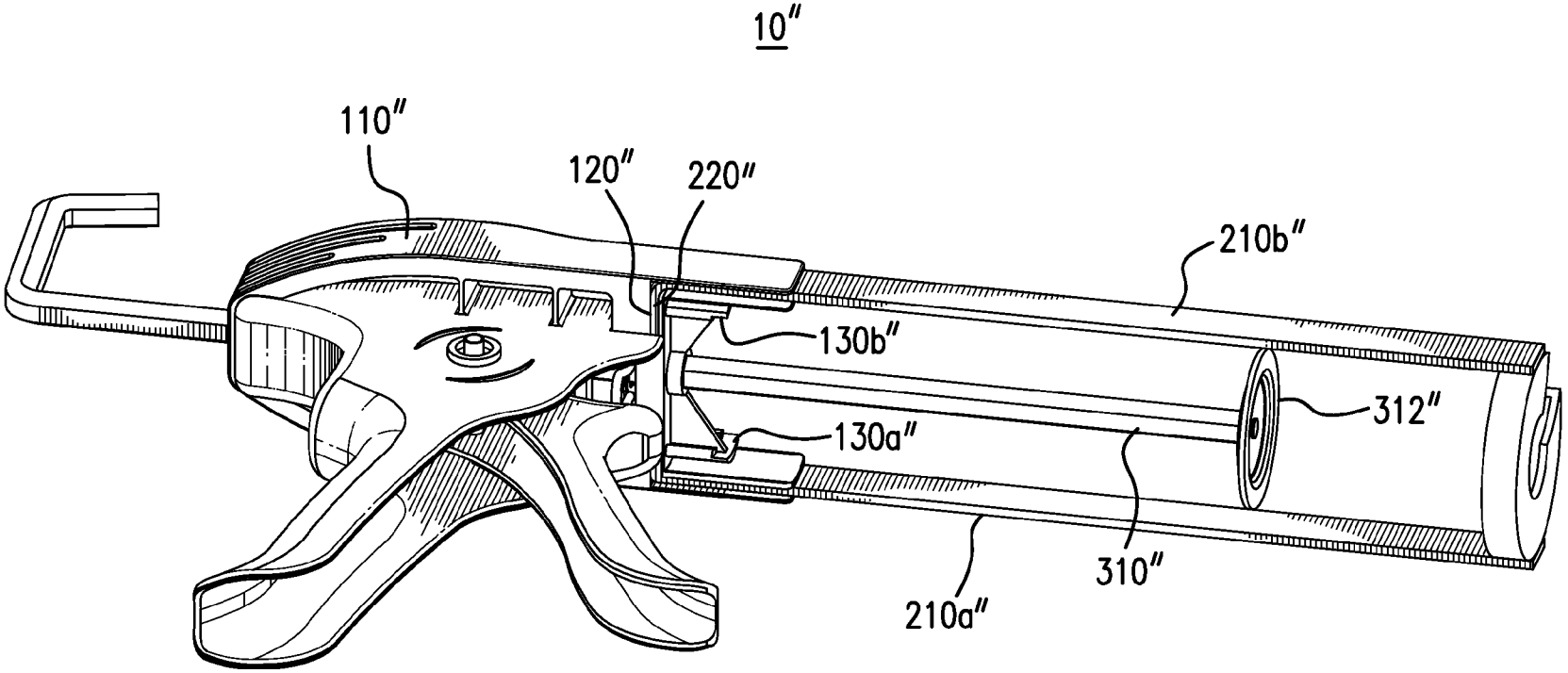
FIG. 11 is a perspective view from a rear lower side of a system formed in accordance with another alternate embodiment of the present invention; and, FIG. 12 is a perspective view from a frontal lower side of the alternate system embodiment of FIG. 11.
Figure 12:
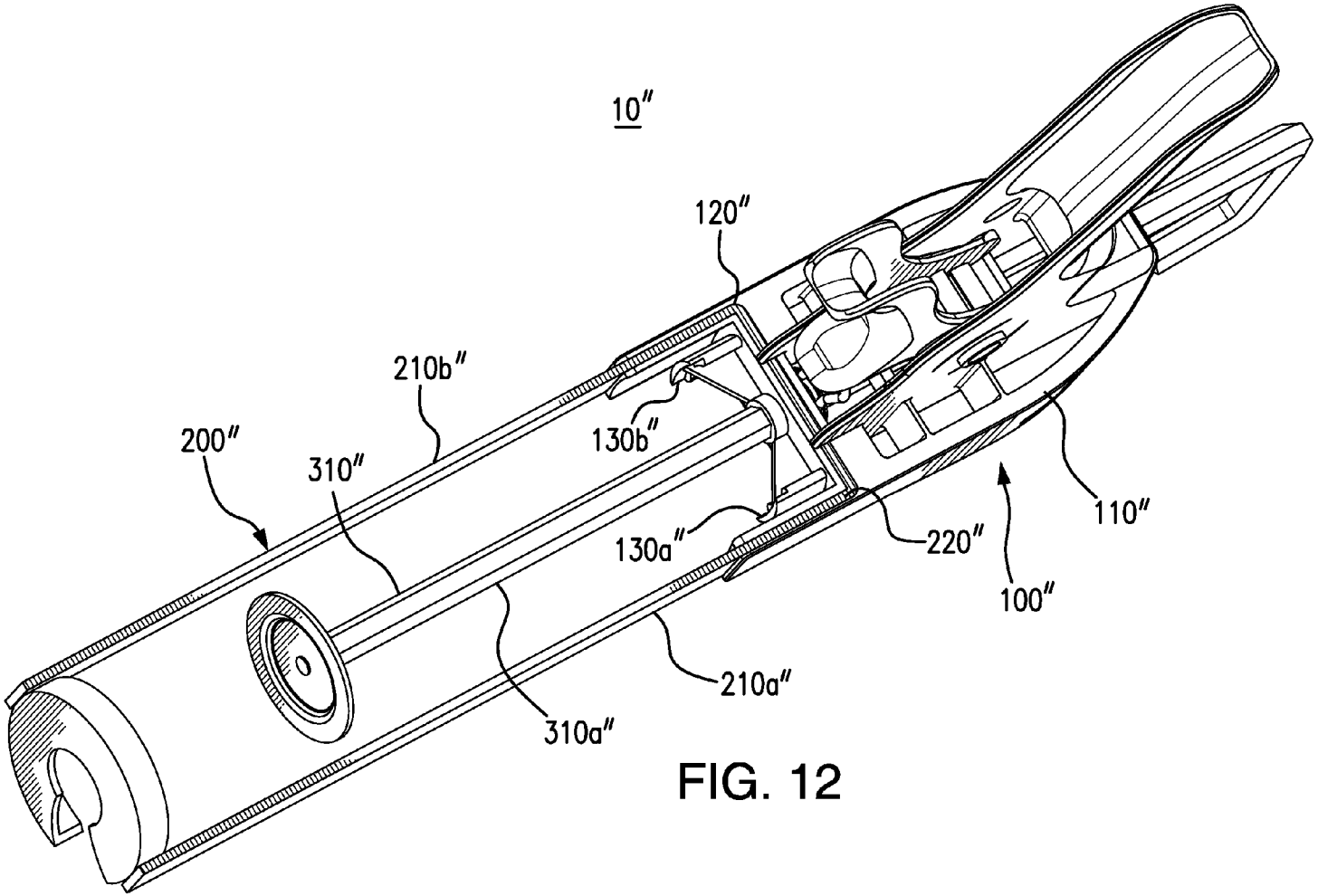

Turning to FIGS. 11-12, there is illustratively shown a lightweight applicator system 10" formed in accordance with yet another exemplary embodiment of the present invention. The applicator system 10" is generally similar in structure and function to the system 10 of the preceding embodiment, employing a similarly configured cartridge frame portion 200" having elongate side frame members 210*a*", 210*b*" which extend longitudinally forward from bends at opposed ends of a cross bracing member 220". As in system 10, the bracing member 220" is received in an embedding groove 120" preferably formed in a forward end of a hub structure 110". The separately constructed cartridge frame portion 200" in this embodiment is suitably coupled to the handle frame portion 100 by force fit insert and capture from the bottom of the proximate closed end (formed integrally by the side frame members 210*a*", 210" and bracing member 220") in tightly conformed manner within the embedding groove 220". Again, where appropriate for the intended application, the proximate closed end may be releasably captured in the embedding groove 220".

The various portions, parts, and components of the system disclosed herein may be formed of any suitable material known in the art for the particular requirements of the intended applications. Metallic, plastic, rubber, and other such materials are employed in view of such factors as the required combination of strength, rigidity, weight, and the like. The present invention is not limited to any particular choice of such material compositions or their combinations.

Although this invention has been described in connection with specific forms and embodiments thereof, it will be appreciated that various modifications other than those discussed above may be resorted to without departing from the spirit or scope of the invention as defined in the appended claims. For example, functionally equivalent elements or processes may be substituted for those specifically shown and described, certain features may be used independently of other features, and in certain cases, particular locations of the elements or processes may be reversed or interposed, all without departing from the spirit or scope of the invention as defined in the appended claims.

What is claimed is:

1. An applicator system for efficient extrusive dispensing of work material from a cartridge comprising:

a body of hybrid compositional structure having a cartridge frame portion of a first material composition coupled to a base frame portion, of a second material composition, said cartridge frame portion including first and second elongate frame members separately projecting longitudinally from a bracing member extending transversely therebetween to define a cartridge loading compartment, said bracing member being integrally formed with said frame members to define therewith a one-piece proximal closed end, at least a portion of said first and second elongate frame members and said bracing member being received in conformed within a substantially U-shaped embedding groove of said base frame portion; and, a drive portion coupled to said body, said drive portion including a drive member selectively displaceable responsive to user actuation for extruding work material from a cartridge retained within said cartridge frame portion.

2. The system as recited in claim 1, wherein said proximal closed end defines with said frame members a substantially u-shaped contour.

3. The system as recited in claim 2, wherein said proximal closed end of said cartridge frame portion is releasably captured within said base frame portion.

4. The system as recited in claim 3, wherein said drive member passes through said base frame portion and said bracing member of said cartridge frame portion to extend in longitudinally displaceable manner into said cartridge loading compartment.

5. The system as recited in claim 1, wherein said body includes a plurality of stabilizing clip members formed to project longitudinally into said cartridge loading compartment, each said clip being formed to retentively engage a proximal end of the cartridge loaded in said cartridge loading compartment.

6. The system as recited in claim 1, wherein said cartridge frame portion is integrally formed of a metallic material, and said base frame portion is formed of a non-metallic material.

7. A lightweight applicator system for extrudably dispensing work material from a cartridge comprising:

a hybrid body having a cartridge frame portion of a first material composition coupled to a base frame portion of a second material composition;

said base frame portion defining a hub structure and a handle extending therefrom;

said cartridge frame portion including a proximal closed end and a plurality of transversely spaced frame members separately projecting longitudinally from said proximal closed end to a distal end to define a cartridge loading compartment therebetween, said proximal closed end having a one-piece configuration formed by a bracing member integrally formed to extend between said frame members, at least a portion of said transversely spaced frame members and said bracing member being captured in conformed manner within a substantially U-shaped embedding groove of said hub structure; and, a drive portion coupled to said hybrid body, said drive portion including a drive member selectively displaceable responsive to user actuation for extruding work material from a cartridge retained within said cartridge frame portion.

8. The system as recited in claim 7, wherein said proximal closed end defines with said frame members a substantially u-shaped contour.

9. The system as recited in claim 8, wherein said proximal closed end is releasably captured within said base frame portion.

10. The system as recited in claim 8, wherein said drive member passes through said hub structure and said proximal closed end of said cartridge frame portion to extend in longitudinally displaceable manner into said cartridge loading compartment.

11. The system as recited in claim 10, wherein said hybrid body includes at least a pair of stabilizing clip members formed to project longitudinally into said cartridge loading compartment at opposing sides of said drive member, each said clip being formed to retentively engage a proximal end of the cartridge loaded in said cartridge loading compartment.

12. The system as recited in claim 11, wherein said cartridge frame portion is integrally formed of a metallic material, and said base frame portion is formed of a non-metallic material.

13. The system as recited in claim 12, wherein said distal end of said cartridge frame portion includes front cap extending between said frame members, said front cap having a notched opening formed therein to supportingly receive an application tip of the cartridge loaded in said cartridge loading compartment.

14. A lightweight applicator system for extrudably dispensing work material from a cartridge comprising:

a body of hybrid compositional structure having a cartridge frame portion of a first material composition coupled to a base frame portion of a second material composition;

said cartridge frame portion including a proximal closed end, a distal end, and a pair of transversely spaced frame members separately projecting longitudinally therebetween to define a skeletal cage structure looped about a cartridge loading compartment, said proximal closed end having a one-piece configuration formed by a bracing member integrally formed to extend between said frame members, at least a portion of said transversely spaced frame members and said bracing member being captured within a substantially U-shaped embedding groove of said base frame portion in at least partially embedded manner;

said base frame portion defining a hub structure and a handle extending therefrom, said hub structure including a plurality of stabilizing clip members extending into said cartridge loading compartment; and, a drive portion coupled to said body, said drive portion including a drive member selectively displaceable responsive to user actuation for engaging a cartridge retained by said cartridge frame portion to extrude work material therefrom.

15. The system as recited in claim 14, wherein said drive member passes through said hub structure of said base frame portion and said proximal closed end of said cartridge frame portion to extend in longitudinally displaceable manner into said cartridge loading compartment, said drive member being disposed transversely between said stabilizing clip members.

16. The system as recited in claim 15, wherein said stabilizing clip members are diametrically offset one from the other, said stabilizing clip members defining respective arcuate surfaces concentrically disposed about said drive member for cooperatively retaining a cylindrical cartridge in longitudinal alignment with said drive member.

17. The system as recited in claim 15, wherein said proximal closed end defines with said frame members a substantially u-shaped contour, said proximal closed end being releasably captured within said base frame portion.

18. The system as recited in claim 15, wherein said drive portion includes a trigger displaceably coupled to said body portion, said drive member being longitudinally advanced progressively into said cartridge loading compartment in ratcheted response to user displacement of said trigger.

19. The system as recited in claim 18, wherein said cartridge frame portion is integrally formed of a metallic material, and said base frame portion is formed of a non-metallic material.

* * * * *